US010190386B2

(12) United States Patent
Stæhr et al.

(10) Patent No.: US 10,190,386 B2
(45) Date of Patent: Jan. 29, 2019

(54) ZONE ISOLATION METHOD AND ANNULAR BARRIER WITH AN ANTI-COLLAPSING UNIT

(71) Applicant: Welltec Oilfield Solutions AG, Zug (CH)

(72) Inventors: Lars Stæhr, Glostrup (DK); Dean Richard Massey, Allerød (DK)

(73) Assignee: Welltec Oilfield Solutions AG, Zug (CH)

( * ) Notice: Subject to any disclaimer, the term of this patent is extended or adjusted under 35 U.S.C. 154(b) by 229 days.

(21) Appl. No.: 15/036,217

(22) PCT Filed: Nov. 24, 2014

(86) PCT No.: PCT/EP2014/075382
§ 371 (c)(1),
(2) Date: May 12, 2016

(87) PCT Pub. No.: WO2015/075224
PCT Pub. Date: May 28, 2015

(65) Prior Publication Data

US 2016/0298414 A1 Oct. 13, 2016

(30) Foreign Application Priority Data

Nov. 25, 2013 (EP) ..... 13194274

(51) Int. Cl.
*E21B 33/127* (2006.01)
*E21B 23/06* (2006.01)
*E21B 34/10* (2006.01)

(52) U.S. Cl.
CPC ..... *E21B 33/127* (2013.01); *E21B 23/06* (2013.01); *E21B 33/1277* (2013.01); *E21B 34/101* (2013.01)

(58) Field of Classification Search
CPC .... E21B 33/127; E21B 23/06; E21B 33/1277; E21B 34/101
See application file for complete search history.

(56) References Cited

U.S. PATENT DOCUMENTS 4,420,159 A * 12/1983 Wood ..... E21B 33/127 166/151
4,527,625 A 7/1985 Wood et al.
(Continued)

FOREIGN PATENT DOCUMENTS

CN 201771467 U 3/2011
CN 102348865 A 2/2012
(Continued)

OTHER PUBLICATIONS

International Search Report and Written Opinion of the ISA for PCT/EP2014/075382, dated Feb. 9, 2015, 9 pages.
(Continued)

*Primary Examiner* — David J Bagnell
*Assistant Examiner* — Jonathan Malikasim
(74) *Attorney, Agent, or Firm* — Nixon & Vanderhye P.C.

(57) ABSTRACT

An annular barrier to be expanded in an annulus between a well tubular structure and a wall of a borehole downhole, includes a tubular metal part for mounting as part of the well tubular structure having an outer face; an expandable sleeve surrounding the tubular metal part and having an inner face facing the tubular metal part and an outer face facing the wall of the borehole, each end of the expandable sleeve being connected with the tubular metal part; and an annular space between the inner face of the expandable sleeve and the tubular metal part, the annular space having a space pressure. The annular barrier has an anti-collapsing unit with an element movable at least between a first position and a
(Continued)

second position, the anti-collapsing unit having first and second inlets and an outlet arranged to allow equalization.

20 Claims, 10 Drawing Sheets

(56) References Cited

U.S. PATENT DOCUMENTS

| | | | | |
|---|---|---|---|---|
| 4,653,588 | A | 3/1987 | White | |
| 5,488,994 | A | 2/1996 | Laurel et al. | |
| 7,387,157 | B2 * | 6/2008 | Gambier | E21B 23/06 166/185 |
| 7,591,321 | B2 * | 9/2009 | Whitsitt | E21B 33/1272 166/187 |
| 8,047,298 | B2 * | 11/2011 | Solhaug | E21B 23/06 166/179 |
| 9,725,980 | B2 * | 8/2017 | Hallundbæk | E21B 33/127 |
| 2007/0056749 | A1 | 3/2007 | Gambier et al. | |
| 2018/0128075 | A1 * | 5/2018 | Stæhr | E21B 34/10 |

FOREIGN PATENT DOCUMENTS

| | | | |
|---|---|---|---|
| RU | 2 101 463 | C1 | 1/1998 |
| RU | 2 128 279 | C1 | 3/1999 |
| RU | 34 621 | U1 | 10/2003 |
| RU | 2 409 736 | C1 | 1/2011 |
| SU | 1113514 | A1 | 9/1984 |
| WO | WO 2010/111076 | A2 | 9/2010 |

OTHER PUBLICATIONS

Notification of the First Office Action dated Feb. 2, 2018 in Chinese Application No. 201480061747.6, with English Translation (10 pages).

Decision on Patent Grant for Invention dated Aug. 14, 2018 issued in Russian Application No. 2016122686 with English translation (21 pages).

* cited by examiner

ZONE ISOLATION METHOD AND ANNULAR BARRIER WITH AN ANTI-COLLAPSING UNIT

This application is the U.S. national phase of International Application No. PCT/EP2014/075382 filed 24 Nov. 2014, which designated the U.S. and claims priority to EP Patent Application No. 13194274.0 filed 25 Nov. 2013, the entire contents of each of which are hereby incorporated by reference.

FIELD OF THE INVENTION

The present invention relates to an annular barrier to be expanded in an annulus between a well tubular structure and a wall of a borehole downhole for providing zone isolation between a first zone having a first pressure and a second zone having a second pressure of the borehole. Furthermore, the invention relates to a downhole system and a zone isolation method.

BACKGROUND ART

When completing a well, production zones are provided by submerging a casing string having annular barriers into a borehole or a casing of the well. When the casing string is in the right position in the borehole or in another casing in the borehole, the annular barriers are expanded or inflated. The annular barriers are in some completions expanded by pressurised fluid, which requires a certain amount of additional energy. In other completions, a compound inside the annular barrier is heated so that the compound becomes gaseous, hence increasing its volume and thus expanding the expandable sleeve.

In order to seal off a zone between a well tubular structure and the borehole or an inner and an outer tubular structure, a second annular barrier is used. The first annular barrier is expanded on one side of the zone to be sealed off, and the second annular barrier is expanded on the other side of that zone, and in this way, the zone is sealed off.

When expanded, annular barriers may be subjected to a continuous pressure or a periodically high pressure from the outside, either in the form of hydraulic pressure within the well environment or in the form of formation pressure. In some circumstances, such pressures may cause the annular barrier to collapse, which may have severe consequences for the area which is to be sealed off by the barrier, as the sealing properties are lost due to the collapse. A similar problem may arise when the expandable sleeve is expanded by an expansion means, e.g. pressurised fluid. If the fluid leaks from the sleeve, the back pressure may fade, and the sleeve itself may thereby collapse.

The ability of the expanded sleeve of an annular barrier to withstand the collapse pressure is thus affected by many variables, such as strength of material, wall thickness, surface area exposed to the collapse pressure, temperature, well fluids, etc.

A collapse rating currently achievable for the expanded sleeve within certain well environments is insufficient for all well applications. Thus, it is desirable to increase the collapse rating to enable annular barriers to be used in all wells, specifically in wells with a high drawdown pressure during production and depletion. The collapse rating may be increased by increasing the wall thickness or the strength of the material, however, this would increase the expansion pressure, which, as already mentioned, is not desirable.

SUMMARY OF THE INVENTION

It is an object of the present invention to wholly or partly overcome the above disadvantages and drawbacks of the prior art. More specifically, it is an object to provide an improved annular barrier which does not collapse, without having to increase the thickness of the expandable sleeve.

The above objects, together with numerous other objects, advantages and features, which will become evident from the below description, are accomplished by a solution in accordance with the present invention by an annular barrier to be expanded in an annulus between a well tubular structure and a wall of a borehole downhole for providing zone isolation between a first zone having a first pressure and a second zone having a second pressure of the borehole, the annular barrier comprising:

- a tubular metal part for mounting as part of the well tubular structure, the tubular metal part having an outer face,
- an expandable sleeve surrounding the tubular metal part and having an inner face facing the tubular metal part and an outer face facing the wall of the borehole, each end of the expandable sleeve being connected with the tubular metal part, and
- an annular space between the inner face of the expandable sleeve and the tubular metal part, the annular space having a space pressure, wherein the annular barrier comprises an anti-collapsing unit comprising an element movable at least between a first position and a second position, the anti-collapsing unit having a first inlet which is in fluid communication with the first zone, and a second inlet which is in fluid communication with the second zone, and the anti-collapsing unit having an outlet which is in fluid communication with the annular space, and in the first position, the first inlet is in fluid communication with the outlet, equalising the first pressure of the first zone with the space pressure, and in the second position, the second inlet is in fluid communication with the outlet equalising the second pressure of the second zone with the space pressure.

In an embodiment, the anti-collapsing unit may comprise a shuttle valve, and the element may be comprised in the shuttle valve.

Furthermore, the anti-collapsing unit may be arranged on the outer face of the tubular metal part or on an outer face of the well tubular structure.

Also, the anti-collapsing unit may be arranged adjacent to or in abutment with the expandable sleeve.

One or both of the ends of the expandable sleeve may be connected with the tubular part by means of connection parts, and the anti-collapsing unit may be arranged outside the annular space adjacent to or in the connection part.

Moreover, one of the connection parts may be slidably connected with the tubular part, and the other connection part may be fixedly connected with the tubular part.

In addition, the anti-collapsing unit may be arranged in or adjacent to the fixedly connected connection part.

Further, the outlet of the anti-collapsing unit may be fluidly connected to the annular space through a fluid channel.

An annular barrier according to any of the preceding claims, wherein the first inlet is fluidly connected with the first zone through an inside of the well tubular structure or the tubular part, or the second inlet is fluidly connected with the second zone through an inside of the well tubular structure or the tubular part.

Also, the fluid channel may be arranged in the connection part.

Additionally, the fluid channel may be arranged in a tube or conduit.

Moreover, the anti-collapsing unit may be arranged in the first or the second zone.

Further, a compound may be enclosed in the annular space.

In addition, the compound may comprise nitrogen.

Also, the compound may be thermally decomposable below a temperature of 400° C.

In an embodiment, the well tubular structure may comprise a first opening opposite the first zone and a second opening opposite the second zone, the second opening being in fluid communication with the first inlet and the first opening through an inside of the well tubular structure.

Furthermore, the first inlet may be in fluid communication with the first zone through a conduit extending through the annular space.

Also, the conduit may extend helically around the outer face of the tubular part.

Additionally, the conduit may be arranged in a channel in a wall of the tubular part.

A screen may be arranged on the outer face of the tubular part and upstream of the first inlet and/or the second inlet.

Moreover, the tubular part may comprise a first tubular part connected with a second tubular part, the expandable sleeve may be connected to the first tubular part, and the anti-collapsing unit may be arranged opposite the second tubular part.

Further, the element may be a piston movable in a piston housing between the first position and the second position, the piston housing comprising a spring being compressed when the piston moves in a first direction.

In addition, the element may be a ball movable within a housing between the first position and the second position.

The housing may have an insert made of a material which is more flexible than a material of the housing.

Also, the shuttle valve may have a housing having an insert made of metal, ceramics, an elastomeric material or a polymeric material.

Moreover, the tubular part may comprise an expansion opening being in fluid communication with the inside of the tubular part and the annular space.

The annular barrier as described above may further comprise a shear pin assembly fluidly connecting the expansion opening and the annular space in order to allow expansion fluid within the well tubular structure to expand the expandable sleeve.

Furthermore, the shear pin assembly may have a first position in which expansion fluid is allowed to flow into the annular space and a second position in which the expansion opening is blocked, preventing expansion fluid from entering the annular space.

Additionally, the shear pin assembly may comprise a shear element, such as a shear pin or disc, adapted to shear at a certain pressure and force the shear pin assembly to shift from the first to the second position.

The insert may comprise a first channel fluidly connected with the first inlet and a second channel fluidly connected with the second inlet, and the ball may move in the first and second channels upon a pressure change in the first or second zone.

Furthermore, the expandable sleeve may be expanded by pressurising an inside of the well tubular structure, and the pressure may be led to the annular space through the second opening and the first inlet of the anti-collapsing unit and from there via the outlet to the annular space.

Also, a compound may be enclosed in the annular space, the compound being adapted to expand the annular space and thereby the expandable sleeve.

Additionally, the tubular part may comprise an expansion opening arranged opposite the annular space, and a one-way valve may be arranged in the expansion opening.

The annular barrier may further comprise a shear pin assembly having a shear pin or disc which shears at a certain pressure during expansion of the annular barrier.

The expandable sleeve of the annular barrier may be made of metal. The tubular part may be made of metal.

The present invention furthermore relates to a downhole system comprising:

- a well tubular structure, and
- an annular barrier according to any of the preceding claims.

The downhole system may further comprise a plurality of annular barriers.

Also, the downhole system may further comprise a frac port.

The present invention also relates to a zone isolation method for providing and maintaining zone isolation between a first zone having a first pressure and a second zone having a second pressure of the borehole, the method comprising the steps of:

- positioning an annular barrier as described above in a well tubular structure,
- expanding the expandable sleeve of the annular barrier to provide zone isolation between the first zone and the second zone of the borehole, and
- maintaining zone isolation between the first zone and the second zone when the first pressure of the first zone is higher than the second pressure of the second zone by equalising the first pressure of the first zone by means of the space pressure by arranging the element in the first position, whereby the first inlet is in fluid communication with the outlet, and
- maintaining zone isolation between the first zone and the second zone when the second pressure of the second zone is higher than the first pressure of the first zone by equalising the second pressure of the second zone by means of the space pressure by arranging the element in the second position, whereby the second inlet is in fluid communication with the outlet.

In an embodiment, the zone isolation method may further comprise the step of equalising the space pressure by means of the first pressure of the first zone when the first pressure drops from the high level, and equalising the space pressure by means of the second pressure of the second zone when the second pressure drops from the high level.

Finally, the present invention relates to the use of the annular barrier described above for maintaining zone isolation between a first and second zone when the first pressure of the first zone or the second pressure of the second zone increases due to hydraulic fracturing/fracking or perforating, or during production.

BRIEF DESCRIPTION OF THE DRAWINGS

The invention and its many advantages will be described in more detail below with reference to the accompanying schematic drawings, which for the purpose of illustration show some non-limiting embodiments and in which.

All the figures are highly schematic and not necessarily to scale, and they show only those parts which are necessary in order to elucidate the invention, other parts being omitted or merely suggested.

DETAILED DESCRIPTION OF THE INVENTION

Figure 1:
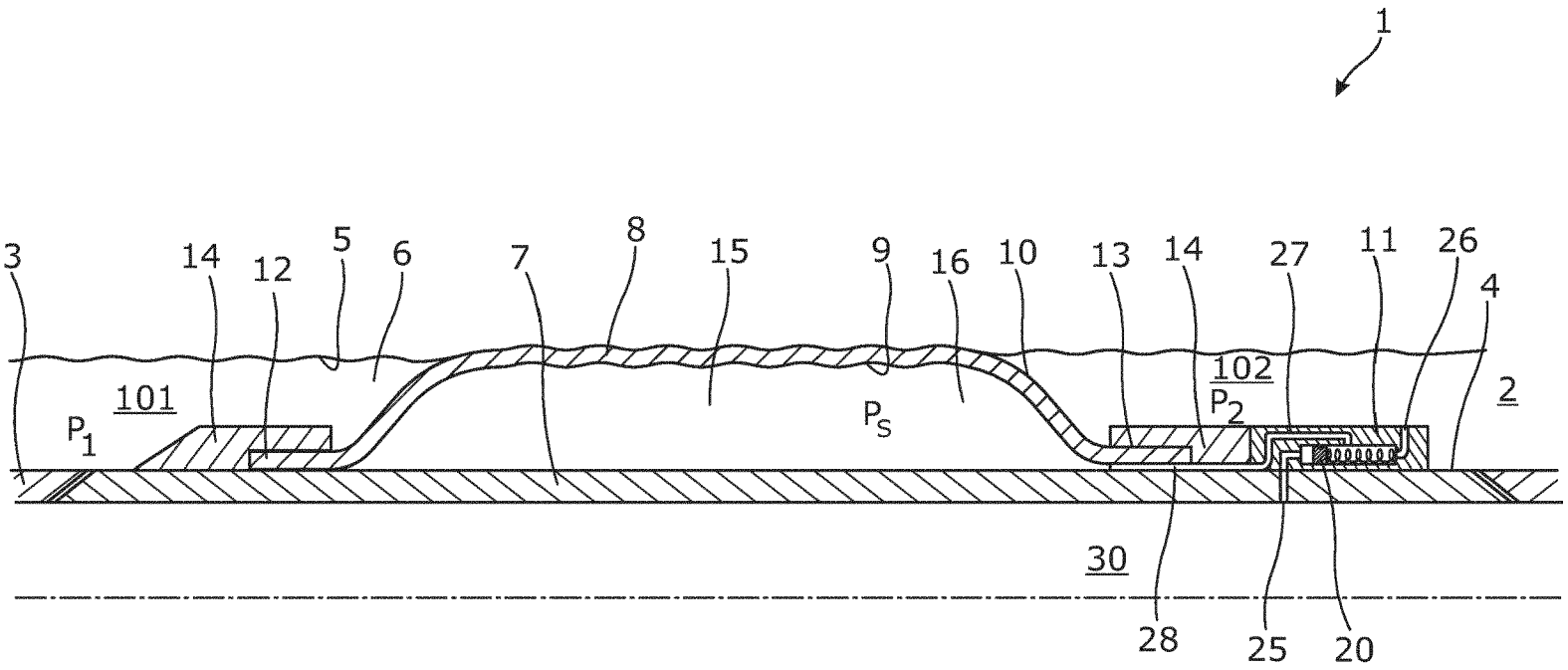
FIG. 1 shows a cross-sectional view of an annular barrier having an anti-collapsing unit.

FIG. 1 shows an annular barrier 1 expanded in an annulus 2 between a well tubular structure 3 and an inside wall 5 of a borehole 6 downhole for providing zone isolation between a first zone 101 and a second zone 102 of the borehole 6. The annular barrier 1 may also be arranged in a casing and may also be used as an anchor of the well tubular structure 3. In the following, the invention will be disclosed in relation to implementation directly in a borehole. The annular barrier 1 comprises a tubular metal part 7 for mounting as part of the well tubular structure 3 and an expandable sleeve 8 surrounding the tubular metal part 7. The expandable sleeve 8 has an inner face 9 facing the tubular metal part 7 and an outer face 10 facing the inside wall 5 of the borehole 6. Each end 12, 13 of the expandable sleeve 8 is connected with the tubular metal part 7, defining an annular space 15 between the inner face 9 of the expandable sleeve 8 and the tubular metal part 7. The annular barrier 1 further comprises an anti-collapsing unit 11 comprising an element 20 movable at least between a first position and a second position. The anti-collapsing unit 11 has a first inlet 25 which is in fluid communication with the first zone 101, a second inlet 26 which is communication with the second zone 102, and an outlet 27 which is in fluid communication with the annular space 15 having a space pressure $P_s$. In the first position, when the first pressure $P_1$ is higher than the space pressure $P_s$ and the second pressure $P_2$, the first inlet 25 is in fluid communication with the outlet 27, equalising the first pressure $P_1$ of the first zone 101 with the space pressure $P_s$. In the first position, more fluid enters the annular space so that the space pressure $P_s$ is increased to be substantially the same as the first pressure. In the second position, when the second pressure $P_2$ is higher than the space pressure $P_s$ and the first pressure $P_1$, the second inlet 26 is in fluid communication with the outlet 27, equalising the second pressure $P_2$ of the second zone 102 with the space pressure $P_2$. In the second position, more fluid enters the annular space so that the space pressure $P_s$ is increased to be substantially the same as the second pressure. In this way, a high pressure in either zone is equalised so that the expandable sleeve is prevented from collapsing.

The annular barrier 1 may be expanded in two ways, namely by enclosing a compound 16 in the space 15 and activating the compound to generate gas or super-critical fluid, or by means of pressurised fluid from within the well tubular structure 3. When expanding the expandable sleeve 8 of the annular barrier 1, the well tubular structure 3 is expanded from within, and the pressurised fluid in the well tubular structure enters the space 15 through the first inlet 25 of the anti-collapsing unit 11. The pressurised fluid presses the element 20 to move, providing access to the outlet 27 which is fluidly connected with the space 15. When expanding the expandable sleeve 8 of the annular barrier 1 by the compound decomposing or chemically reacting, a one-way valve or a shear disc/pin may be arranged in the channel 28 fluidly connected with the outlet 27 to prevent the gas or super-critical fluid from escaping the space during expansion. The compound is thermally decomposable below a temperature of 400° C.

After expanding the expandable sleeve 8 of the annular barrier 1, the first pressure $P_1$ in the first zone 101 may increase, e.g. during fracturing or production, and then, the space pressure $P_s$ needs to be equalised to be approximately the same as the first pressure $P_1$ in order to avoid the expandable sleeve 8 collapsing and thus breaking the isolation between the first and second zones 101, 102.

Figure 2:
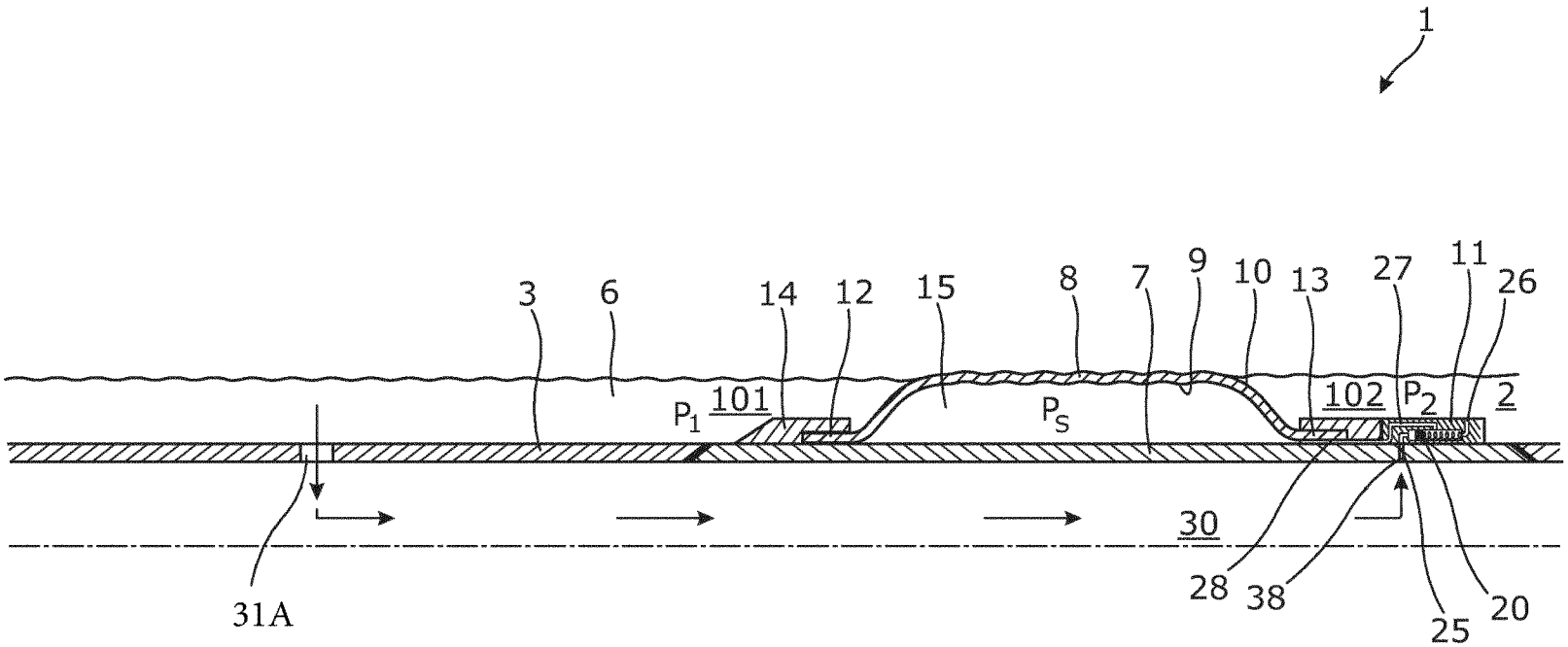
FIG. 2 shows a cross-sectional view of another annular barrier.

In FIG. 2, a first opening 31*a* in the well tubular structure 3 in the first zone 101 is in fluid communication with a second opening 38 in the tubular metal part 7 opposite the second zone 102 through the inside 30 of the well tubular structure. The first opening 31*a* is thus in fluid communication with the first inlet 25 of the anti-collapsing unit 11, as indicated by arrows, and fluid access is provided to the space 15, should the first pressure $P_1$ be higher than the space pressure $P_s$ and the second pressure $P_2$. If the second pressure $P_2$ of the second zone 102 is higher than the first pressure $P_1$, the space pressure $P_s$ is equalised with the second pressure $P_2$ through the second inlet 26. The second pressure $P_2$ moves the element 20 in the anti-collapsing unit 11, thereby providing fluid communication with the space 15.

Figure 3:
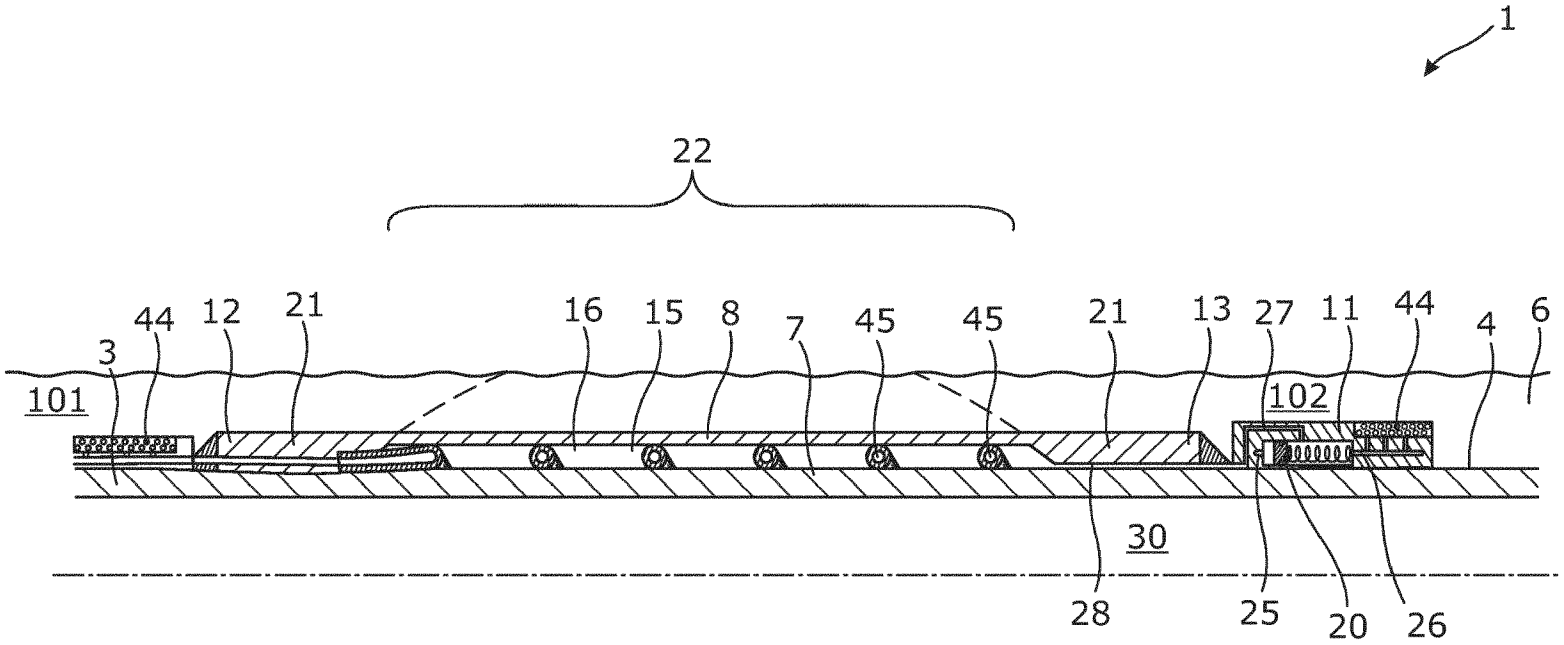
FIG. 3 shows a cross-sectional view of another annular barrier having a conduit extending inside the annular barrier.

In FIGS. 1 and 2, the expandable sleeve 8 is connected with the tubular metal part 7 by means of connection parts 14 so that the expandable sleeve 8 is squeezed between the connection parts and the tubular part 7. In FIG. 3, the expandable sleeve 8 is welded to the tubular part 7. The fluid channel 28 connecting the outlet 27 of the anti-collapsing unit 11 with the space 15 is in FIGS. 1 and 2 arranged in the connection parts 14 and in FIG. 3 in a first section 21 of the sleeve 8 at the second end 13 of the expandable sleeve 8 as a groove or bore. Thus, the fluid channel 28 may be arranged in a tube or conduit 45 in the connection parts 14 or the second end of the expandable sleeve 8.

Figure 11:
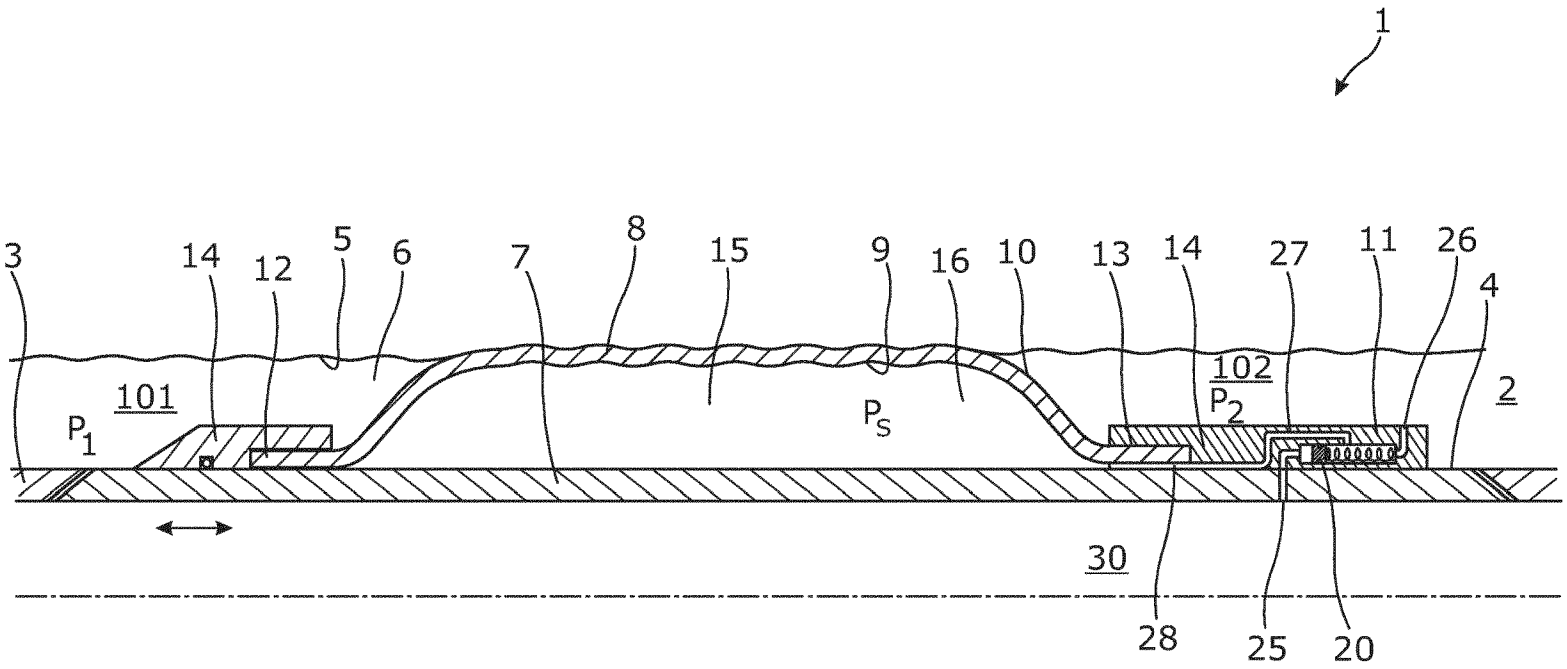
FIG. 11 shows a cross-sectional view of yet another annular barrier.

The anti-collapsing unit 11 may comprise a shuttle valve, and the element 20 is comprised in the shuttle valve shifting back and forth between the first position and the second position depending on the pressure in the first and second zones 101, 102. The anti-collapsing unit 11 is arranged on an outer face 4 of the tubular metal part 7 or on an outer face 4 of the well tubular structure 3. As shown in FIGS. 1 and 2, the anti-collapsing unit 11 is arranged adjacent to the expandable sleeve 8, abutting the connection parts 14 of the second end 13 of the expandable sleeve 8. In FIG. 3, the anti-collapsing unit 11 is arranged in abutment with the expandable sleeve 8. In FIG. 11, the anti-collapsing unit 11 is arranged outside the annular space 15 in the connection parts 14.

In FIG. 3, the first inlet 25 of the anti-collapsing unit 11 is in fluid communication with the first zone 101 through a conduit 45 extending through the annular space 15. Furthermore, a screen 44 is arranged on the outer face of the tubular part 7 and upstream of the first inlet 25 and the second inlet 26. The conduit 45 is fastened to the first end 12 of the expandable sleeve 8 and is in fluid communication with the first zone 101 through a channel in the first end 12 of the expandable sleeve 8 and through a screen 44 or filter 44 arranged outside the space 15 adjacent to the expandable sleeve 8. The fluid from the first zone 101 flows in through the screen 44 so that only very small particles are allowed to flow with the fluid into the conduit 45 and further into the anti-collapsing unit 11 arranged in the second zone 102. The fluid from the second zone 102 is in the same way let in through a screen 44 or filter 44 before entering the anti-collapsing unit 11.

Figure 4:
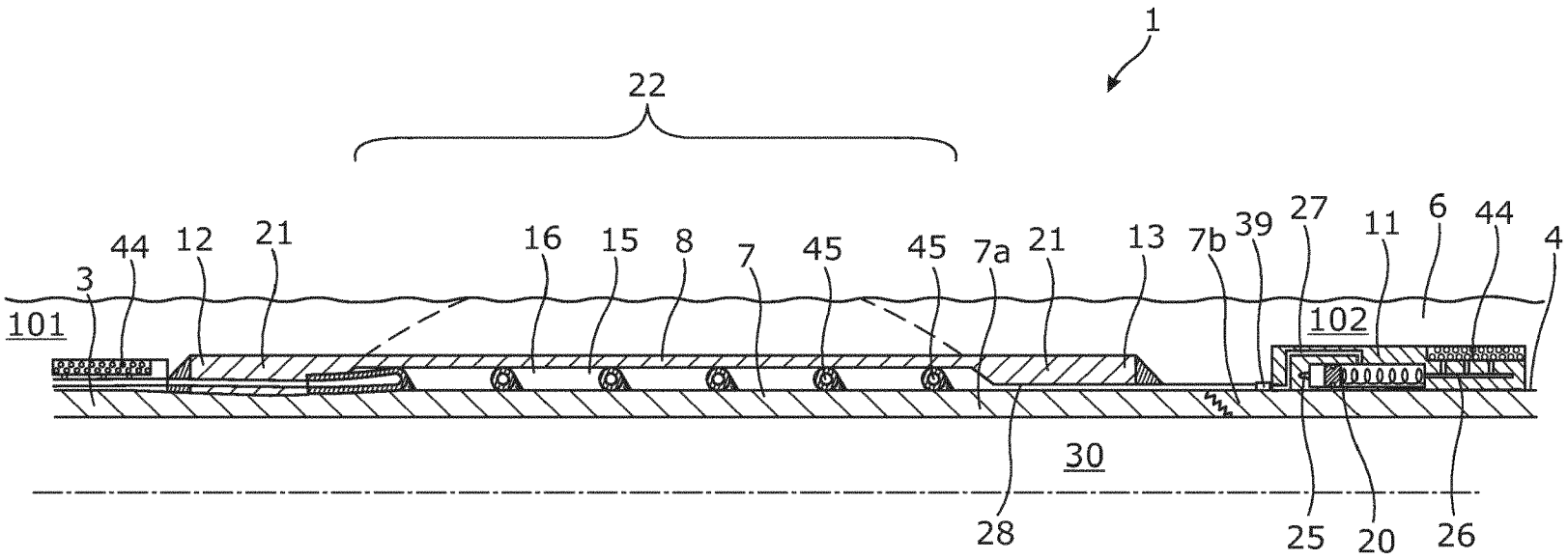
FIG. 4 shows a cross-sectional view of another annular barrier comprising two modules which are threadedly connected.

The conduit 45 shown in FIGS. 3 and 4 is arranged in the space 15 and extends helically around the outer face 4 of the tubular part 7. The conduit 45 thus also functions as an anti-collapsing means during insertion of the annular barrier in the borehole. During insertion of the well tubular structure 3, the expandable sleeve 8 may hit against projections in the borehole, which could cause the expandable sleeve 8 to slightly collapse inwards if the conduit 45 was not present. The conduit 45 may be connected with the first inlet 25 of the anti-collapsing unit 11 in another cross-sectional plane than that shown in FIG. 3. The dotted line illustrates the position of the expandable sleeve 8 after expansion.

In FIG. 3, the expandable sleeve 8 has a second section 22 between two first sections 21, and the first sections have a first thickness which is larger than a second thickness of the second section 22. Thus, a higher expansion pressure is required for expanding the first sections 21 of the sleeve 8 than for expanding the second sections 22 of the sleeve 8. Furthermore, the first section 21 of the expandable sleeve 8 has a first inner diameter, and the second section 22 of the expandable sleeve has a second inner diameter. The second inner diameter is larger than the first inner diameter. When the first inner diameter is smaller than the second inner diameter, the pressure required for expanding the sleeve section with the first inner diameter is higher than the pressure required for expanding the section with the second inner diameter. The compound 16 in the annular space 15 generates a certain amount of expansion energy, and if the inner diameter of the borehole 6 is smaller than expected at a location where the annular barrier 1 is to be expanded, there we will be an excess of expansion energy. This excess of expansion energy can then be used to also expand the section of the sleeve with the smaller inner diameter and/or a greater thickness. Thus, the first sections 21 of the sleeve functions as a passive pressure compensation function since expansion of this section happens when there is an excess of expansion energy.

The tubular part 7 shown in FIG. 4 is divided into a first tubular part 7*a* connected with a second tubular part 7*b*. The expandable sleeve 8 is connected to the first tubular part 7*a* and the anti-collapsing unit 11 is connected to the second tubular part 7*b*. The first tubular part 7*a* and the second tubular part 7*b* are threadedly connected, and the fluid channel 28 connecting the outlet 27 with the space 15 is formed by a tube connected to the outlet 27 by means of a connection 39. In this way, the annular barrier 1 can be assembled from an annular barrier module and an add-on module comprising the anti-collapsing unit 11. An annular barrier needs to be qualified in order to be allowed to be inserted in a well downhole, and such a qualification procedure of a separate anti-collapsing module may be substantially simplified when the annular barrier is already qualified and the anti-collapsing module is a non-integrated module in the annular barrier.

Figure 5:
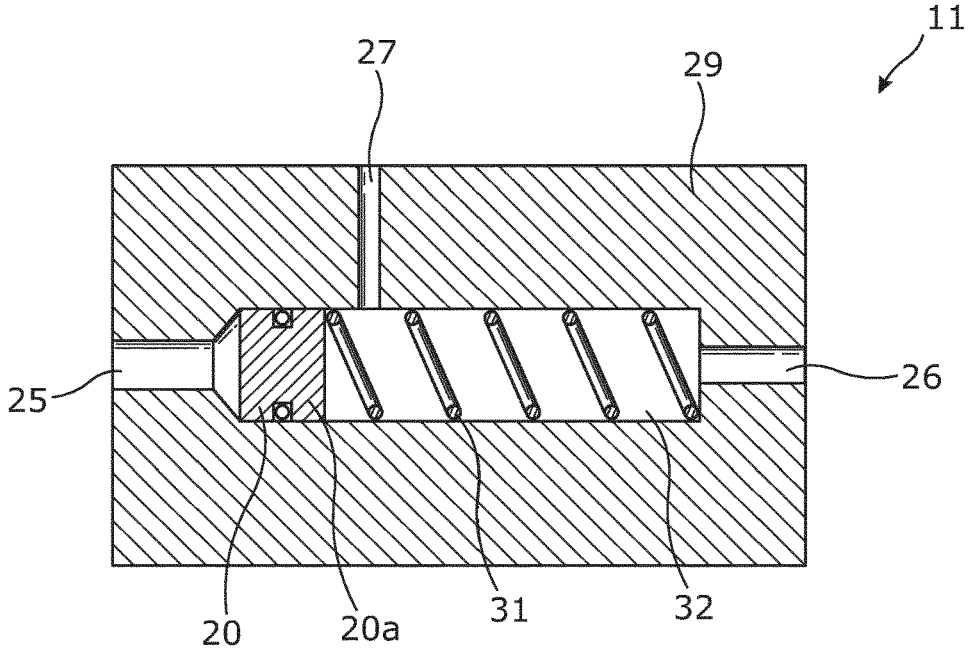
FIG. 5 shows a cross-sectional view of an anti-collapsing unit with a piston element.

In FIG. 5, the anti-collapsing unit 11 is a shuttle valve, and the element 20 of the valve is a piston 20*a* movable in a piston housing 29 between the first position and the second position. The piston housing 29 has a bore 32 in which a spring 31 is arranged. The spring 31 is compressed when the piston 20*a* moves in a first direction towards the second inlet 26 and the first pressure is higher than the space pressure and the second pressure. The piston 20*a* moves until access is provided to the outlet 27, and thus until fluid communication to the space is provided. When the space pressure has been equalised with the first pressure, the spring 31 forces the piston 20*a* back, thereby shutting off the fluid communication between the first inlet 25 and the outlet 27, and allowing for fluid communication between the second zone and the space.

Figure 6:
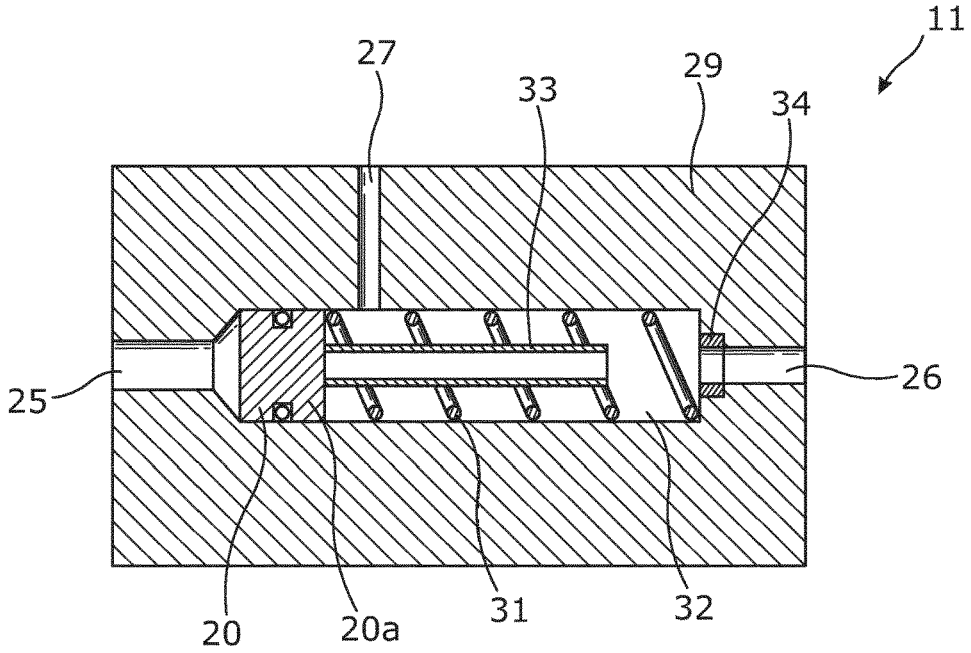
FIG. 6 shows a cross-sectional view of another anti-collapsing unit with a piston element.

In the anti-collapsing unit 11 of FIG. 6, the element 20 comprises a piston 20*a* and a piston rod 33. The second inlet 26 is provided with a sealing means 34 so that the piston rod 33 engages the sealing means and provides a back-up seal to an o-ring provided around the piston 20*a*. By having a piston rod 33, the spring 31 is furthermore guided during compression, which prevents it from getting stuck.

Figure 7:
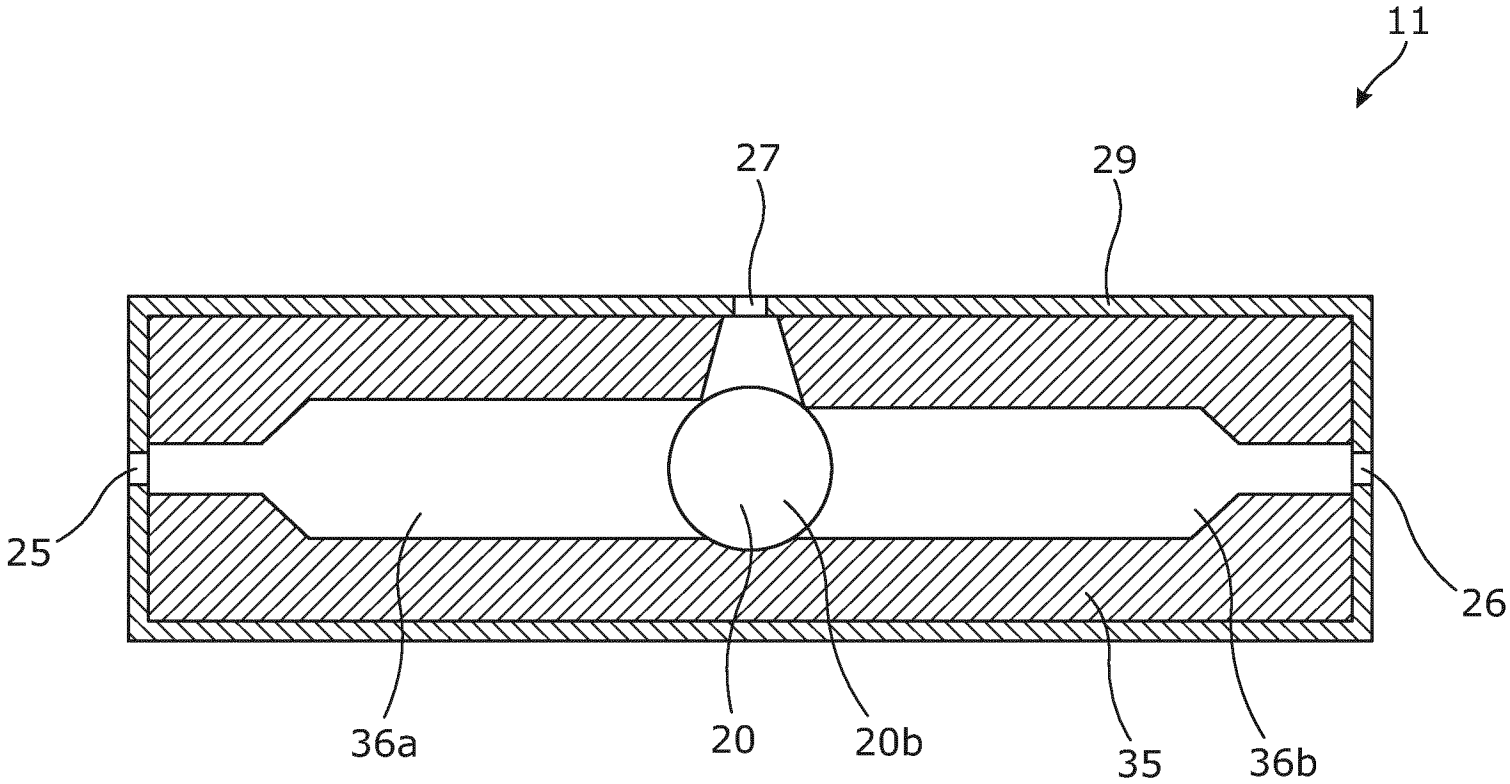
FIG. 7 shows a cross-sectional view of an anti-collapsing unit with a ball element.

As shown in FIG. 7, the element 20 may also be a ball 20*b* which is movable within a housing 29 between the first position and the second position. The housing 29 has an insert 35 made of a material which is more flexible than a material of the housing, such as an elastomeric material. In this way, the insert 35 functions as the seal, and the ball 20*b* wipes the seal clean from small particles. The insert 35 has a first channel 36*a* and a second channel 36*b*, and as the insert is worn during use, the ball 20*b* is forced further into the first or the second channel, respectively. By having such elongated first and second channels made of a flexible material, the anti-collapsing unit 11 is capable of functioning with a higher number of repetitions than normal shuttle valves.

Figure 8:
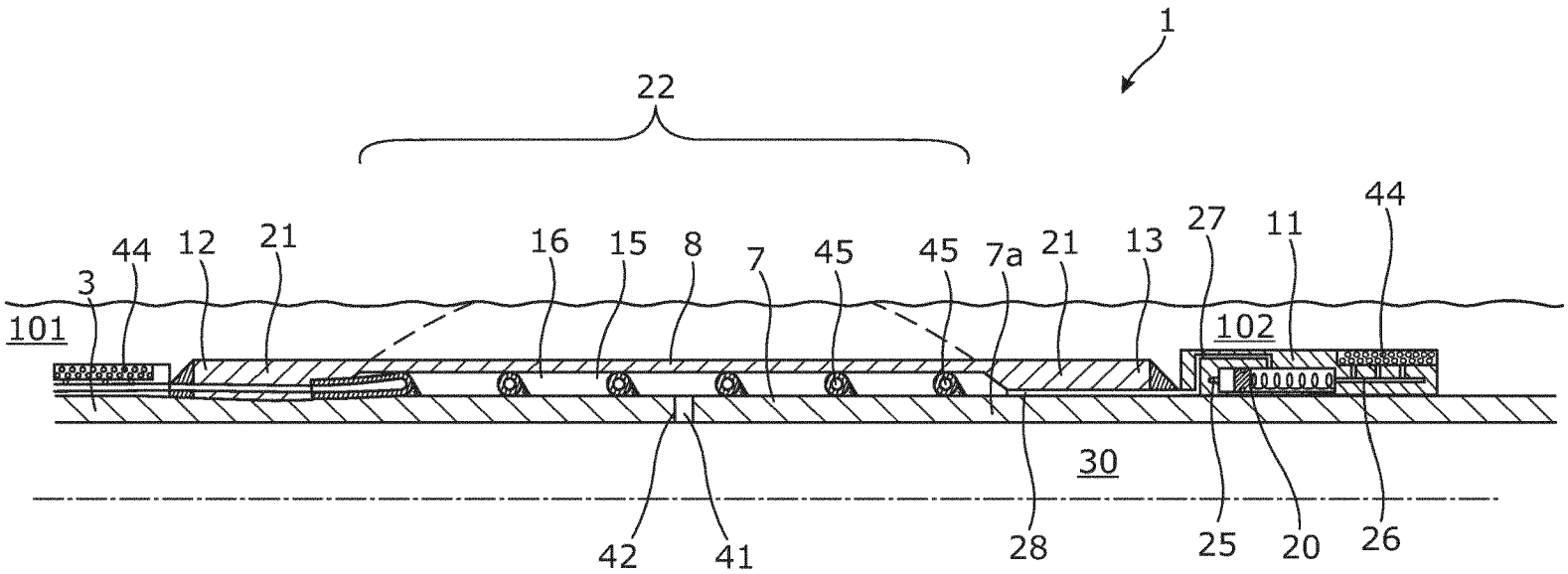
FIG. 8 shows a cross-sectional view of another annular barrier having screens.

In FIG. 8, the tubular part 7 of the annular barrier 1 comprises an expansion opening 41 arranged opposite the annular space 15. In order to prevent fluid from escaping the space 15 during a pressure equalisation, a one-way valve 42 is arranged in the expansion opening.

Figure 9:
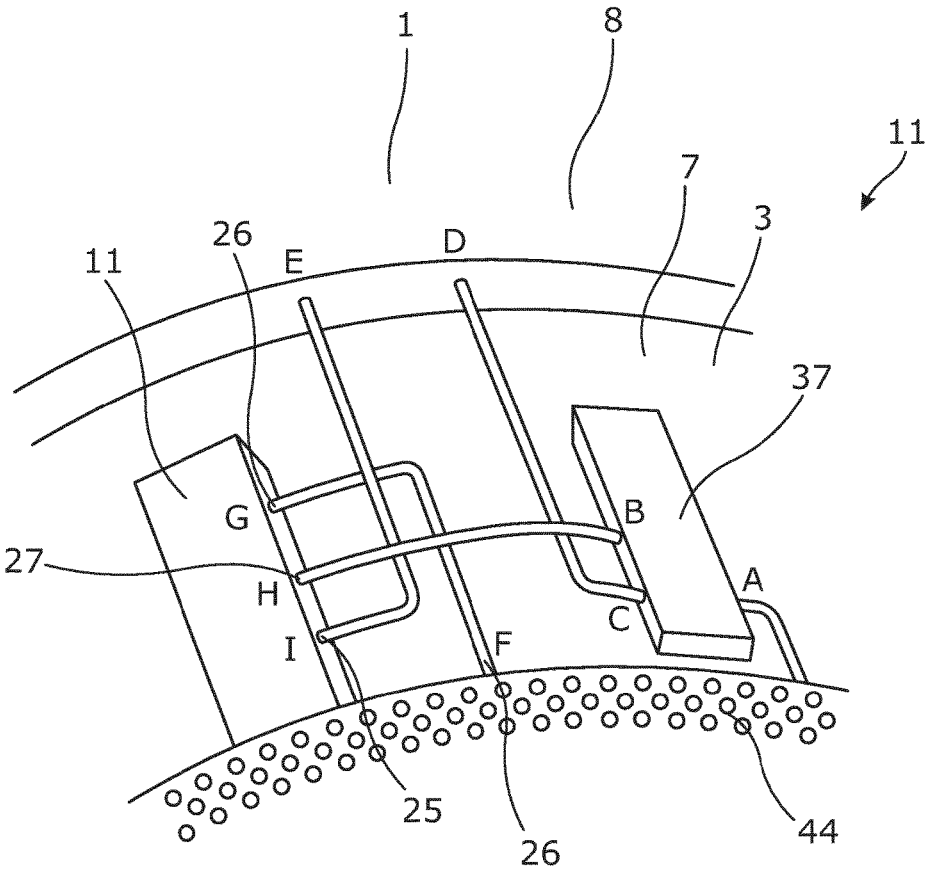
FIG. 9 shows a partial view of another annular barrier in perspective.

As shown in FIG. 9, the annular barrier 1 further comprises a shear pin assembly 37. The shear pin assembly 37 has a port A receiving fluid from an inside of the well tubular structure 3 through the screen 44. The port A is fluidly connected with a port D during expansion, causing the expansion fluid within the well tubular structure to expand the expandable sleeve 8. When the expandable sleeve 8 is expanded to abut the wall of the borehole, the pressure builds up and a shear pin or disc within the shear pin assembly shears closing the fluid connection from port A and opens the fluid connection between a port B and a port C, so that fluid from the second inlet can be let into the space through the shear pin assembly. When the first pressure increases in the first zone, fluid from a port E connected with a port I, being the first inlet 25, presses the element to move so that fluid communication is provided between port I and a port H, being the outlet, and thus further through ports B and C and into the space through port D. When the second pressure increases in the second zone, the element is forced in the opposite direction, and fluid communication between ports G and port H is provided, i.e. fluid communication between the second inlet and the outlet of the anti-collapsing unit 11, and thus, fluid is let into the space through ports B, C and D.

In FIG. 11, one of the connection parts 14 is slidably connected with the tubular part 7, and the other connection part is fixedly connected with the tubular part.

As mentioned, a compound 16 may be enclosed in the annular space 15, and the compound is adapted to expand the annular space and thereby the expandable sleeve 8. When the compound 16 entrapped in the expandable space chemically reacts or thermally decomposes below a temperature of 400° C., thereby generating gas or super-critical fluid, the expandable sleeve 8 is expanded until the outer face 10 of the sleeve 8 presses towards the inner face 5 of the borehole 6, as shown in FIG. 1. When using an enclosed compound 16 in the space 15 and an expandable sleeve 8 made of metal, the expandable sleeve 8 may be welded or in another way fixedly connected to the tubular metal part 7 without connection parts.

The compound 16 comprised in the space 15 may comprise nitrogen and may be selected from a group of ammonium dichromate, ammonium nitrate, ammonium nitrite, barium azide, sodium nitrate, or a combination thereof. These nitrogen-containing compounds decompose when heated, e.g. by flushing the casing with hot steam or a heated fluid which heats the compound 16 by heating the tubular metal part 7. At many well sites, hot steam is available as it is used for bringing up hydrocarbon-containing fluid from the reservoir, and hot steam can therefore also be used for expanding annular barriers.

The compound 16 in the space 15 may be present in the form of a powder, a powder dispersed in a liquid or a powder dissolved in a liquid. Thus, the compound 16 may be in a solid or liquid state, and the liquid may be water, mud or well fluid. As the compound 16 is heated, the compound decomposes into gas or super-critical fluid and water, and the expandable sleeve 8 is thereby expanded. Whether it is gas or super-critical fluid depends on the pressure and temperature downhole. If the pressure is higher than expected, the decomposition could create a super-critical fluid instead of a gas.

Figure 10:
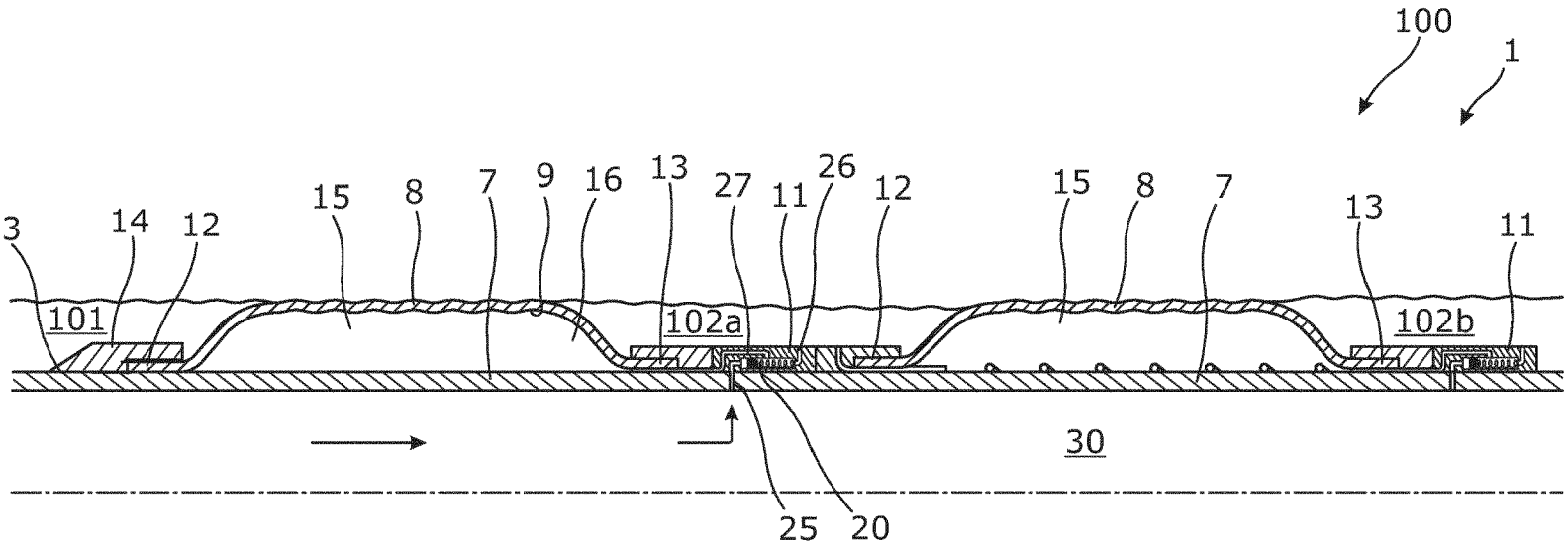
FIG. 10 shows a cross-sectional view of a downhole system having two annular barriers with anti-collapsing units.

FIG. 10 shows a downhole system 100 comprising two annular barriers each having an anti-collapsing unit 11. The anti-collapsing unit 11 arranged between the annular barriers has a first inlet 25 fluidly connected through an opening to the inside 30 of the well tubular structure 3, and a second inlet 26 which is fluidly connected with the second zone 102*a* between the annular barriers. The anti-collapsing unit 11 arranged in the second zone 102*a* on the other side of one of the annular barriers 1 has an inlet which is fluidly connected with the zone between the annular barriers 102*a* through the conduit extending in the space of that annular barrier, and a second inlet 26 fluidly connected with the second zone 102*b*.

The invention thus also relates to a zone isolation method for providing and maintaining zone isolation between a first zone 101 having a first pressure $P_1$ and a second zone 102 having a second pressure $P_2$ of the borehole 6. First, the annular barrier 1 is positioned in a well tubular structure 3, then the expandable sleeve 8 of the annular barrier is expanded to provide zone isolation between the first zone and the second zone of the borehole. When the first pressure of the first zone is higher than the second pressure of the second zone, the zone isolation between the first zone and the second zone is maintained by equalising the first pressure of the first zone with the space pressure by arranging the element 20 in the first position, whereby the first inlet is in fluid communication with the outlet. When the second pressure of the second zone is higher than the first pressure of the first zone, the zone isolation between the first zone and the second zone is maintained by equalising the second pressure of the second zone with the space pressure by arranging the element in the second position, whereby the second inlet is in fluid communication with the outlet.

By fluid or well fluid is meant any kind of fluid that may be present in oil or gas wells downhole, such as natural gas, oil, oil mud, crude oil, water, etc. By gas is meant any kind of gas composition present in a well, completion, or open hole, and by oil is meant any kind of oil composition, such as crude oil, an oil-containing fluid, etc. Gas, oil, and water fluids may thus all comprise other elements or substances than gas, oil, and/or water, respectively.

By a casing is meant any kind of pipe, tubing, tubular, liner, string etc. used downhole in relation to oil or natural gas production.

Although the invention has been described in the above in connection with preferred embodiments of the invention, it will be evident for a person skilled in the art that several modifications are conceivable without departing from the invention as defined by the following claims.

The invention claimed is:

1. An annular barrier to be expanded in an annulus between a well tubular structure and a wall of a borehole downhole for providing zone isolation between a first zone having a first pressure and a second zone having a second pressure of the borehole, the annular barrier comprising:

a tubular metal part for mounting as part of the well tubular structure, the tubular metal part having an outer face, an expandable sleeve surrounding the tubular metal part and having an inner face facing the tubular metal part and an outer face facing the wall of the borehole, each end of the expandable sleeve being connected with the tubular metal part, and an annular space between the inner face of the expandable sleeve and the tubular metal part, the annular space having a space pressure, wherein the annular barrier comprises an anti-collapsing unit comprising an element movable at least between a first position and a second position, the anti-collapsing unit having a first inlet which is in fluid communication with the first zone, and a second inlet which is in fluid communication with the second zone, and the anti-collapsing unit having an outlet which is in fluid communication with the annular space, and in the first position, the first inlet is in fluid communication with the outlet, equalising the first pressure of the first zone with the space pressure, and in the second position, the second inlet is in fluid communication with the outlet, equalising the second pressure of the second zone with the space pressure.

2. The annular barrier according to claim 1, wherein the anti-collapsing unit comprises a shuttle valve and the element is comprised in the shuttle valve.

3. The annular barrier according to claim 1, wherein the anti-collapsing unit is arranged on the outer face of the tubular metal part or on an outer face of the well tubular structure.

4. The annular barrier according to claim 1, wherein the anti-collapsing unit is arranged adjacent to or in abutment with the expandable sleeve.

5. The annular barrier according to claim 1, wherein one or both of the ends of the expandable sleeve is/are connected with the tubular part by means of connection parts, and the anti-collapsing unit is arranged outside the annular space adjacent to or in the connection part.

6. The annular barrier according to claim 1, wherein the outlet of the anti-collapsing unit is fluidly connected to the annular space through a fluid channel.

7. The annular barrier according to claim 1, wherein the anti-collapsing unit is arranged in the first or the second zone.

8. The annular barrier according to claim 1, wherein a compound is enclosed in the annular space.

9. The annular barrier according to claim 8, wherein the compound comprises nitrogen.

10. The annular barrier according to claim 8, wherein the compound is thermally decomposable below a temperature of 400° C.

11. The annular barrier according to claim 1, wherein the well tubular structure comprises a first opening opposite the first zone and a second opening opposite the second zone, the second opening being in fluid communication with the first inlet and the first opening through an inside of the well tubular structure.

12. The annular barrier according to claim 1, wherein the first inlet is in fluid communication with the first zone through a conduit extending through the annular space.

13. The annular barrier according to claim 1, wherein a screen is arranged on the outer face of the tubular part and upstream of the first inlet and/or the second inlet.

14. The annular barrier according to claim 1, wherein the element is a piston movable in a piston housing between the first position and the second position, the piston housing comprising a spring being compressed when the piston moves in a first direction.

15. The annular barrier according to claim 2, wherein the shuttle valve has a housing having an insert made of metal, ceramics, an elastomeric material or a polymeric material.

16. The annular barrier according to claim 1, wherein the tubular part comprises an expansion opening being in fluid communication with the inside of the tubular part and the annular space.

17. The annular barrier according to claim 16, further comprising a shear pin assembly fluidly connecting the expansion opening and the annular space in order to allow expansion fluid within the well tubular structure to expand the expandable sleeve.

18. The annular barrier according to claim 17, wherein the shear pin assembly has a first position in which expansion fluid is allowed to flow into the annular space and a second position in which the expansion opening is blocked, preventing expansion fluid from entering the annular space.

19. A downhole system comprising:

a well tubular structure, and the annular barrier according to claim 1.

20. A zone isolation method for providing and maintaining zone isolation between a first zone having a first pressure and a second zone having a second pressure of the borehole, the method comprising the steps of:

positioning the annular barrier according to claim 1 in a well tubular structure, expanding the expandable sleeve of the annular barrier to provide zone isolation between the first zone and the second zone of the borehole, and maintaining zone isolation between the first zone and the second zone when the first pressure of the first zone is higher than the second pressure of the second zone by equalising the first pressure of the first zone with the space pressure by arranging the element in the first position, whereby the first inlet is in fluid communication with the outlet, and maintaining zone isolation between the first zone and the second zone when the second pressure of the second zone is higher than the first pressure of the first zone by equalising the second pressure of the second zone with the space pressure by arranging the element in the second position, whereby the second inlet is in fluid communication with the outlet.

* * * * *